United States Patent [19]

Collier

[11] 4,201,429

[45] May 6, 1980

[54] CABINET DRAWER GUIDE AND SLIDE CONNECTOR

[76] Inventor: David L. Collier, 255 NW. 95th Ave., Portland, Oreg. 97229

[21] Appl. No.: 959,789

[22] Filed: Nov. 13, 1978

[51] Int. Cl.[2] ..... A47B 88/00

[52] U.S. Cl. ..... 312/330 R; 312/333; 312/348; 308/3.8

[58] Field of Search ..... 312/330 R, 333, 341, 312/348, 350, 342, 343, 339, 340; 308/3.8, 3.6

[56] References Cited

U.S. PATENT DOCUMENTS

| | | | |
|---|---|---|---|
| 2,799,541 | 7/1957 | Wolters | 312/341 |
| 3,203,749 | 8/1965 | Bullock et al. | 312/339 |
| 3,205,025 | 9/1965 | Jordan | 312/348 |
| 3,318,800 | 5/1943 | Rakow | 308/3.6 |
| 3,352,617 | 11/1967 | Dargene | 312/343 |
| 3,488,097 | 1/1970 | Fall | 312/340 |
| 3,574,421 | 4/1971 | Stein | 308/3.8 |
| 3,675,883 | 7/1972 | Holmes et al. | 312/343 |
| 3,771,849 | 11/1973 | Barber | 308/3.8 |
| 3,778,120 | 12/1973 | Hagen et al. | 312/340 |

*Primary Examiner*—Victor N. Sakran
*Attorney, Agent, or Firm*—Oliver D. Olson

[57] ABSTRACT

A cabinet drawer is supported for sliding movement in a cabinet by means of an elongated guide secured to the cabinet frame and a cooperating elongated slide secured to the drawer, the guide and slide being secured to the cabinet frame and drawer, respectively, each by a connector comprising a body member adapted to be secured to the cabinet or drawer and having a slot arranged to removably receive a tab projecting from the guide or slide, and a locking member mounted movably on the body member and arranged for retractable reception through aligned transverse openings in the connector body and tab, for releasably securing the tab to the connector body.

9 Claims, 9 Drawing Figures

CABINET DRAWER GUIDE AND SLIDE CONNECTOR

BACKGROUND OF THE INVENTION

This invention relates to cabinet drawers, and more particularly to a connector by which to secure guide and slide components to the frame and drawer respectively, of a cabinet.

In the construction of built-in cabinets, such as kitchen cabinets made of wood, it is the general practice to form the guide and slide components as integral, rigid parts of the frame and drawer, respectively. Obviously, this method is not usable for cabinets of the knock-down type which are sold as packaged units and erected by the do-it-yourselfer.

Guide and slide components for cabinet drawers also have been provided heretofore for attachment to the frame and drawer components, respectively, of wood cabinets, by means of screws. This type of assembly is time consuming and also inaccurate, resulting in misalignment of components, poor operation of the drawer and unprofessional appearance.

Guide and slide components for cabinet drawers also have been provided heretofore for attachment to the sides of frame and drawer components, respectively, of metal cabinets, by means of bolts and spring-loaded clips arranged to register with openings formed in the frame and drawer components. Exemplary of this type of drawer support are those described in U.S. Pat. Nos. 3,778,120; 3,771,849; and 3,205,025. In this type of drawer support, the requirements of precise locating and forming of the openings and clips contribute to costly manufacture and time consuming assembly. Further, disassembly is rendered difficult by resistance to separation of the spring-loaded clips.

SUMMARY OF THE INVENTION

In its basic concept, the cabinet drawer guide and slide connector of this invention comprises a body member having a slot arranged to receive a tab on the guide or slide, and a locking member arranged for retractable reception through aligned transverse openings in the body member and tab.

It is by virtue of the foregoing basic concept that the principal objective of this invention is achieved; namely, to overcome the aforementioned disadvantages and limitations of prior cabinet drawer supports.

Another objective of this invention is the provision of a connector of the class described which accommodates adjustment of the drawer to the cabinet frame after the guide and slide components have been installed on the frame and drawer, respectively.

Still another objective of this invention is the provision of a connector of the class described which enables the use of a single guide and slide assembly for each drawer.

A further objective of this invention is the provision of a connector of the class described which may be secured to cabinet frame members and cabinet drawers prior to packaging the cabinet components for shipment in knocked-down condition, while maintaining the size of the packaged units at a minimum.

A still further objective of this invention is the provision of a connector of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 2:
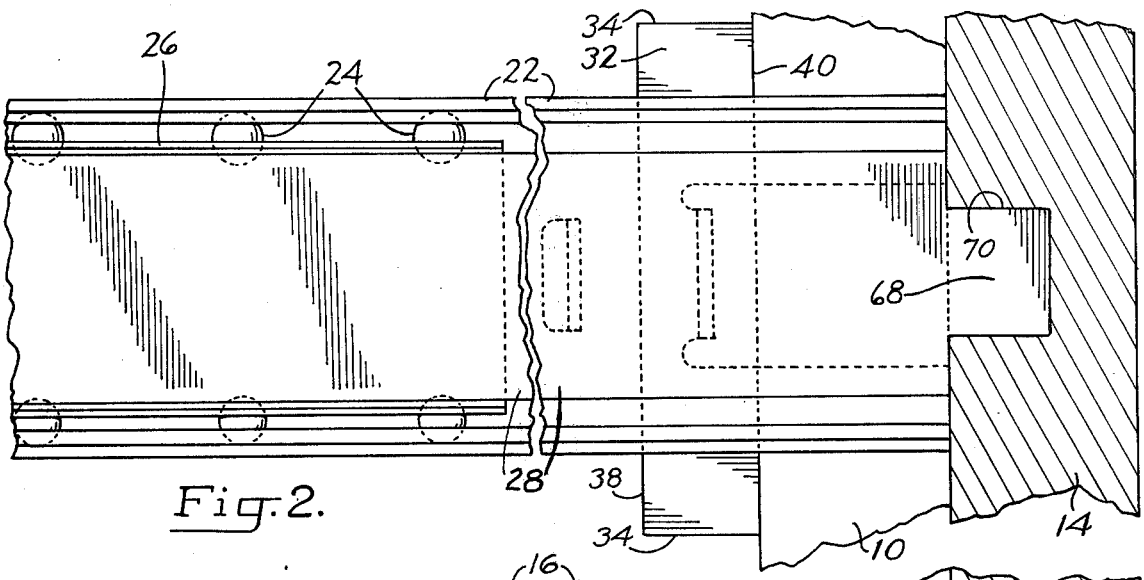
FIG. 2 is a fragmentary, foreshortened horizontal section taken on the line 2—2 in FIG. 1.

For purposes of illustration, the drawings show conventional components of a cabinet frame and associated drawer. Thus, the cabinet frame includes a front frame member 10 and a rear frame member 12. As is well known, the front and rear frame members are interconnected by transverse frame members (not shown) some of which are positioned to support the bottom side edges of a drawer, to provide lateral stability for the latter. Also, as is well known, the front frame member is provided with a rectangular opening for the removable reception of a cabinet drawer.

The drawings illustrate a cabinet drawer which includes the front, decorative wall 14, laterally spaced side walls 16, rear wall 18 and bottom wall 20.

The drawer is supported on the cabinet frame for slidable extension and retraction, by means of an elongated guide member secured to the cabinet frame and a cooperating elongated slide member secured to the drawer. The conventional form of guide and slide illustrated in the drawing is of the type disclosed in the prior art patents the numbers of which are identified hereinbefore. Thus, the guide member comprises an elongated metal channel-shaped member 22 the opposite inner side portions of which form races for a plurality of ball bearings 24 supported in longitudinally spaced-apart relationship by means of a short carriage 26. The slide member comprises an elongated metal channel member 28 the outer side portions of which also form bearing races for the ball bearings. The balls and races thus secure the guide and slide members together for relative longitudinal displacement.

In accordance with this invention, the guide and slide members are secured to the cabinet frame members and drawer, respectively, by means of a novel connector now to be described.

The connector of this invention includes a body member 30, preferably molded of synthetic thermoplastic resin. It includes a top side 32, lateral sides 34, bottom side 36, front side 38 and rear side 42. It is provided intermediate its lateral sides with a laterally elongated slot 42 which extends inward from the top side 32 preferably through the bottom side 36. Intercepting said slot is a transverse opening 44 which extends from the front side 38 of the body preferably through the back side 40 thereof.

The body member is adapted to be secured to the drawer and frame components of the cabinet. Although the attachment may be achieved by adhesive or glue, it preferably is provided by means of a pair of screws 46 which extend through counterbored holes 48 which extend through the body from the front side 38 to the back side 40 on opposite sides of the transverse opening 44.

Figure 4:
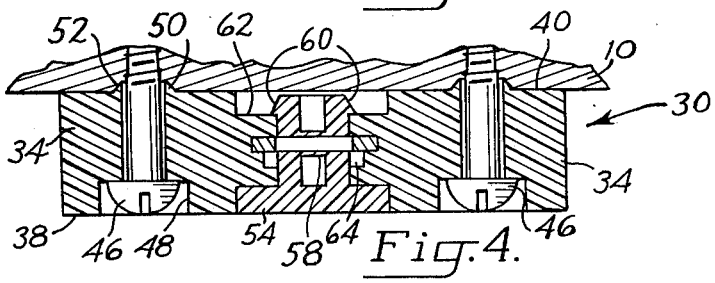
FIG. 4 is a fragmentary sectional view taken on the line 4—4 in FIG. 3.

As best illustrated in FIG. 4, indexing means preferably is provided for locating the body member in predetermined position on a frame member of the cabinet or the back wall of the drawer, and with speed and facility. This indexing means is provided by an annular shoulder 50 projecting rearward from the back surface of the body member around each of the screw receiving holes 48. The cabinet frame member and back wall of the drawer are provided with registering sockets 52 arranged in predetermined positions to receive the annular indexing shoulders.

Associated with the body member is a locking member. It includes an enlarged head portion 54 and a shank portion 56 dimensioned for reception freely through the transverse opening 44 in the body member. The front side of the body member is recessed around the transverse opening to receive the enlarged head of the locking member when the latter is extended into the transverse opening in the locking position.

Figure 5:
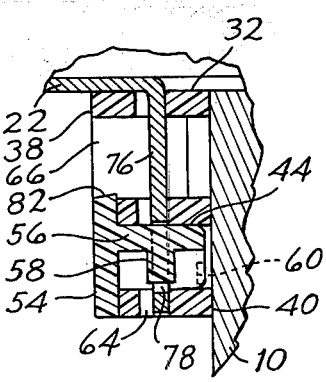
FIG. 5 is a fragmentary sectional view taken on the line 5—5 in FIG. 3.

In the preferred embodiment illustrated, the shank 56 of the locking member is substantially U-shaped in cross section (FIGS. 4 and 5) to provide laterally spaced resilient sides. A web 58 interconnects the resilient sides intermediate their ends to stiffen the latter somewhat and yet allow inward deflection of the outer ends. These outer ends are provided with laterally projecting catches 60 which serve to retain the locking member against complete detachment from the body member, except under a positive pulling force. In this manner the body member and locking member are secured together against accidental separation.

The laterally projecting catches 60 cooperate with a recess 62 in the back side 40 of the body member, registering with the transverse opening 44, and also with a slot 42 extending inward from the top side of the body member. Thus, with the locking member shank 56 extended into the body member in the locking position illustrated in FIG. 4, the catches 60 engage the inner surface of the rear recess 62.

The locking member is retractable from the position illustrated in FIG. 4, as by engaging a finger nail in the space between the enlarged head 54 and the adjacent recessed surface in the body member, to urge the locking member outward of the body. The resilience of the U-shaped shank of the locking member allows the catches to be deflected inward to the cross sectional profile of the transverse opening 44, whereby the locking member may be retracted. When the catches enter the slot 64 outwardly of the main lateral slot 42, they again engage the body member to prevent further retraction of the locking member.

The body member is provided with a laterally elongated pocket 66 which extends inward from its front side 38 between the screw holes 48 and the top side 32, terminating inwardly of the back side 40 and the lateral sides 34. This laterally elongated pocket serves to support the rear end of an elongated guide member 22, as described hereinafter.

The connector described hereinbefore functions to secure the elongated slide member 28 to the cabinet drawer, as follows: The front end of the slide member is provided with a forwardly projecting tongue 68 (FIGS. 1 and 2) and a correspondingly dimensioned pocket 70 is provided in the inner surface of the front wall 14 of the drawer, to receive it. This pocket is located centrally between the lateral sides of the drawer, so as to position the slide member along the longitudinal center line of the drawer under the bottom wall 20 thereof.

Figure 7:
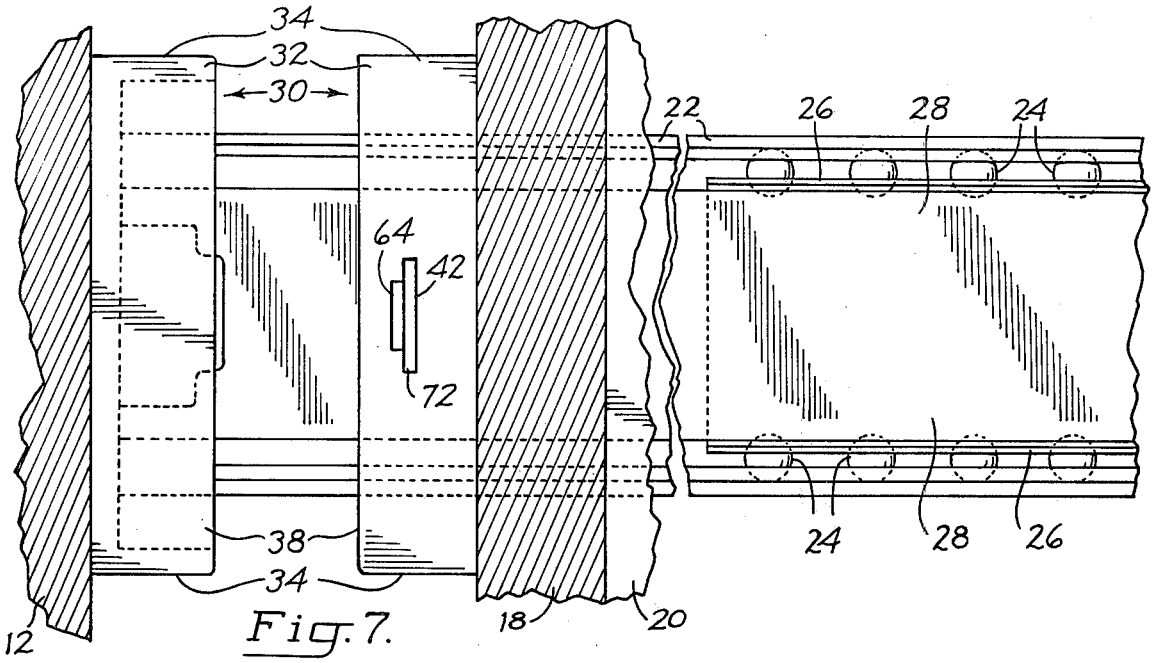
FIG. 7 is a fragmentary, foreshortened plan view, as viewed from the top of FIG. 6.

The rearward end of the slide member is secured to the rearward end of the drawer by means of one of the connectors described hereinbefore. Thus (FIGS. 6 and 7), the body member 30 is secured to the rear side of the back wall 20 of the drawer, centrally of the lateral sides thereof, with the top side 32 of the body member facing downward and the front side 38 facing rearward. A rearward, central portion of the metal slide member is struck upwardly at right angles to the longitudinal dimension of the slide member, to form a connecting tab 72 which is extended upward through the laterally elongated slot 42 in the body member. A transverse opening 74 in the tab is arranged to register with the transverse opening 44 in the body member when the tab is extended fully into the lateral opening 42, whereupon the locking member shank 56 is extended fully into the transverse opening 44, in the manner illustrated in FIG. 4, whereby the shank extends through the opening in the tab and thus secures the latter to the body member.

Figure 1:
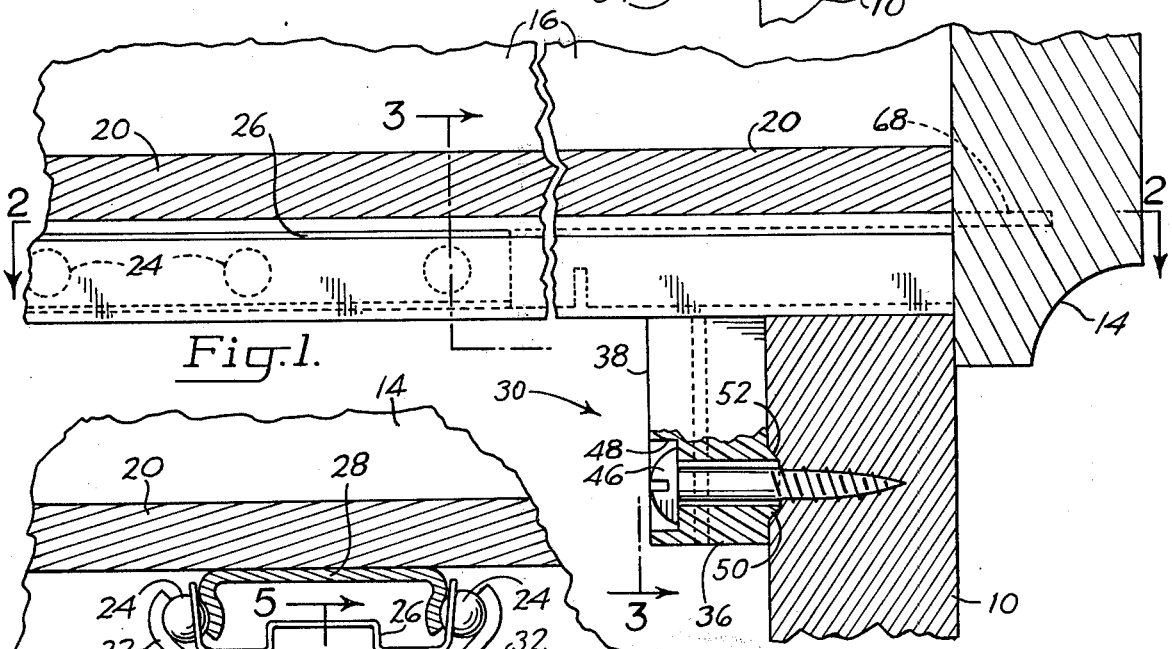
FIG. 1 is a fragmentary, foreshortened vertical section of the front portion of a cabinet and drawer incorporating therewith a connector embodying the features of this invention.
Figure 3:
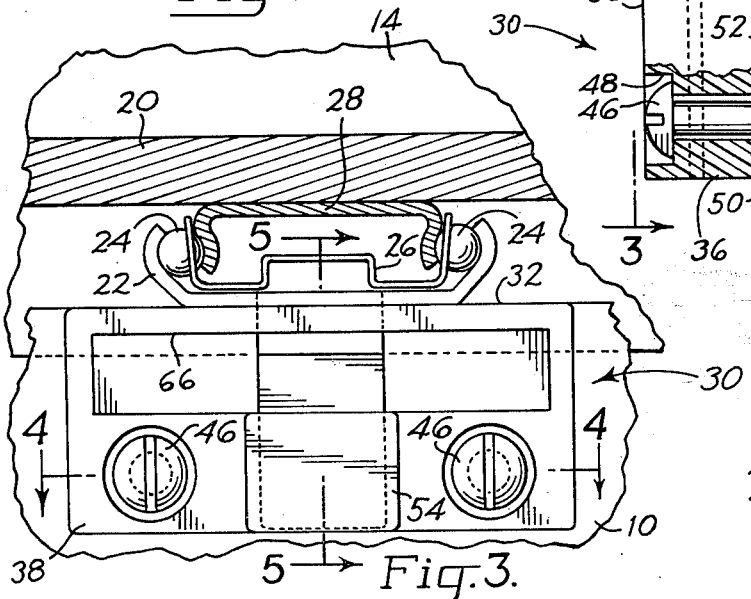
FIG. 3 is a fragmentary transverse section taken on the line 3—3 in FIG. 1.

The connector described hereinbefore functions to mount the front end of the elongated guide member 22, as follows: Referring to FIG. 1 of the drawings, the body member 30 is secured to the inner side of the front frame member 10 centrally of the lateral sides of the opening which receives the drawer. The forward end of the elongated guide member is provided with a downwardly extending tab 76. Conveniently, the tab is provided by striking a forward, central portion of the metal guide member downward at right angles to its longitudinal dimension. A transverse opening 78 is provided in the tab in position registering with the transverse opening 44 in the body member when the tab is inserted fully into the laterally elongated slot 42 in the body member. The locking member shank 56 then is pushed into the transverse opening to the extended position illustrated in FIG. 4, whereby the shank extends through the opening in the tab and thus secures the latter to the body member.

Figure 9:
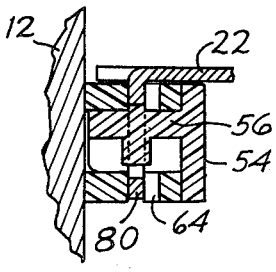
FIG. 9 is a fragmentary sectional view, similar to FIG. 5, showing a modified connector for use in place of the connector at the rear end of the guide in FIG. 6.
Figure 8:
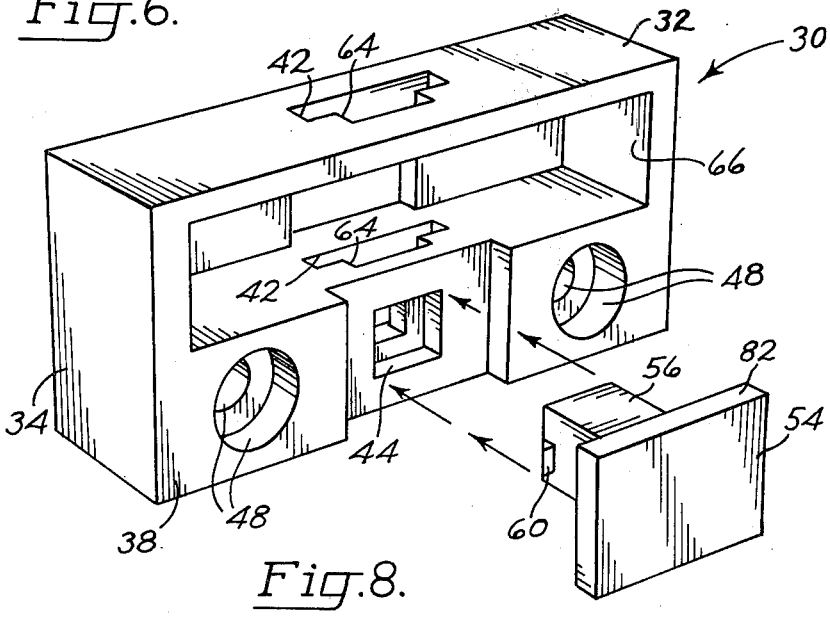
FIG. 8 is a perspective view, on a substantially enlarged scale of the connector illustrated in the preceding views.

The rearward end of the elongated guide member 22 may be secured in the same manner as the forward end, by use of a second connector and providing a downwardly struck tab 80 at the rearward end of the guide member. Such an arrangement is illustrated in FIG. 9. In this case the laterally elongated pocket 66 may be omitted. However, the use of the laterally elongated pocket provided in the body member is preferred for mounting the rearward end of the guide member. Thus, referring to FIG. 6 of the drawings, the body member 30 is secured to the back frame member 12 of the cabinet in approximate alignment with the connector secured to the inner side of the front frame member 10 of the cabinet. The rearward end of the guide member is positioned within the laterally elongated pocket 66, before the locking member shank 56 has been extended through the transverse opening 44. The drawer is then pushed inward to its fully retracted position. In doing so, the rearward end of the guide member may move laterally to adjust itself to the position of the slide member 28 secured to the drawer. Then, the locking member shank is extended into the transverse opening 44 to a position illustrated in FIG. 6.

Figure 6:
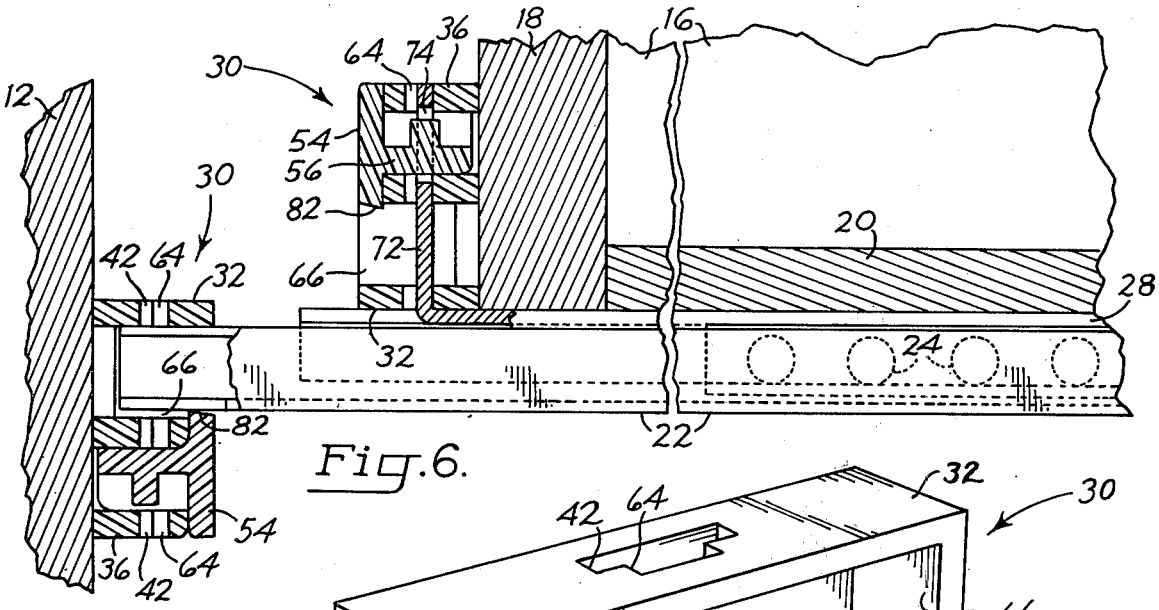
FIG. 6 is a fragmentary, foreshortened vertical section of the rear portion of the cabinet and the drawer, as an extension of FIG. 1, incorporating therewith a pair of the connectors embodying the features of this invention.

It is to be noted in FIG. 6 that the upper transverse edge 82 of the enlarged head 54 of the locking member is inclined toward the body member, with its inner edge projecting slightly above the bottom surface of the laterally elongated pocket 66. Thus, as the locking member shank is extended into the transverse opening 44, the upper edge 82 of the enlarged head bears against the underside of the guide member 22 and forces it upward, bringing the upper lateral edges of the guide member into gripping engagement with the upper surface of the laterally elongated pocket 66. This frictional engagement secures the guide member in properly adjusted position.

From the foregoing, it will be apparent that the connector of this invention may be utilized with a wide variety of types of guide and slide assemblies. In this regard, the only requirement is that the guide member 22 be provided with a downwardly extending tab 76 adjacent its forward end and that the slide member 28 be provided with an upwardly projecting tab 72 adjacent its rearward end, for cooperative association with the corresponding connectors of this invention, in the manner previously described. The rearward end of the guide member may be secured to the rear frame member of the cabinet by use of the connector illustrated in FIG. 6, or it may be provided with a downwardly extending tab 80 for association with a connector as demonstrated in FIG. 9.

It will be apparent to those skilled in the art that various changes may be made in the size, shape, type, number and arrangement of parts described hereinbefore. For example, the front end of a slide member may be secured to the drawer by screws instead of the tongue 68 and routed pocket 70. The illustrated arrangement is preferred for its simplicity and preciseness. A slide member may be secured to each lateral side of a drawer and an associated guide member may be secured to the corresponding side frame members of a cabinet. The illustrated arrangement is preferred, since it minimizes the number of components. The slide member or guide member may be secured to the associated drawer or cabinet frame by means other than the connector of this invention. It is preferred, however, to employ the connectors for both slide and guide members, as described hereinbefore, for ease, speed and accuracy of assembly of the cabinet. The connector of this invention also may be employed for attaching other forms of structural members together, it being required only that one of the structural members be provided with a tab projecting from it in a position for extension into the transverse opening 44 of the body member 30 secured to the other structural member.

Having now described my invention and the manner in which it may be used, I claim:

1. For use in attaching a first member releasably to a second member, wherein the first member has a tab projecting therefrom and a transverse opening is provided in the tab, a connector comprising:

(a) a body member having a slot extending inwardly from one side thereof for receiving said tab, and a transverse opening extending inwardly from a perpendicular side thereof and intercepting said slot, the transverse opening in the body member registering with the transverse opening in said tab when the tab is received in the slot, (b) a locking member extending retractably through the registering transverse openings in the body member and tab for securing the tab respectively to the body member, and (c) means for securing the body member to the second member.

2. For use in mounting a drawer in a cabinet frame, a connector assembly comprising:

(a) an elongated slide member arranged for attachment to the drawer for supporting the latter for movement relative to the frame, (b) an elongated guide member coupled to the slide member and arranged for attachment to the frame, (c) a connector for attaching at least one of the slide and guide members to the associated drawer and frame, respectively, the connector comprising (1) a body member having a slot extending inwardly from one side thereof and a transverse opening extending inwardly from a perpendicular side thereof and intercepting said slot, (2) the elongated member to be attached having a tab projecting laterally therefrom for reception in the slot, the tab having a transverse opening arranged to register with the transverse opening in the body member when the tab is received in the slot, and (3) a locking member extending retractably through the registering transverse openings in the body member and tab for securing the tab to the body member, and (d) means for securing the body member to the drawer or cabinet frame to which the elongated member is to be attached.

3. The connector assembly of claim 2 wherein:

(a) the body member has a laterally elongated pocket in its front side arranged to receive the rear end of a guide member, and (b) the locking member has a projection on its outer end intercepting the plane of the adjacent side of said pocket, for engaging the guide member and moving it into frictional engagement with the opposite side of said pocket.

4. In combination with a drawer and a cabinet frame, (a) an elongated slide member arranged for attachment to the drawer for supporting the latter for movement relative to the frame, (b) an elongated guide member coupled to the slide member and arranged for attachment to the frame, (c) a connector for attaching at least one of the slide and guide members to the associated drawer and frame, respectively, the connector comprising (1) a body member having a slot extending inwardly from one side thereof and a transverse opening extending inwardly from a perpendicular side thereof and intercepting said slot, (2) the elongated member to be attached having a tab projecting laterally therefrom for reception in the slot, the tab having a transverse opening arranged to register with the transverse opening in the body member when the tab is received in the slot, and (3) a locking member extending retractably through the registering transverse openings in the body member and tab for securing the tab to the body member, and (d) means for securing the body member to the drawer or cabinet frame to which the elongated member is to be attached.

5. The combination of claim 4 wherein (a) the body member has a laterally elongated pocket in its front side arranged to receive the rear end of the guide member, and (b) the locking member has a projection on its outer end intercepting the plane of the adjacent side of said pocket, for engaging the guide member and moving it into frictional engagement with the opposite side of said pocket.

6. The combination of claim 4 wherein (a) the slide member has a forwardly projecting tongue on its front end and the drawer has a front wall provided with a pocket arranged to receive said tongue, (b) the tab on the slide member is arranged to project therefrom parallel to and slightly rearward of the back wall of the drawer, and (c) the body member is secured to the back wall of the drawer.

7. The combination of claim 6 wherein the pocket in the front wall of the drawer is located centrally of the lateral ends of said front wall under the bottom wall of the drawer, and the body member is secured to the back wall of the drawer centrally of the lateral sides of said back wall.

8. The combination of claim 7 wherein the cabinet frame includes front and rear frame members and the tab on the guide member is arranged to project therefrom slightly rearward of the front frame member, and the ody member is secured to the front frame member centrally of the lateral sides of the drawer.

9. The combination of claim 4 wherein (a) the cabinet frame includes front and rear frame members, (b) a first tab on the guide member is arranged to project therefrom slightly rearward of the front frame member, (c) a second tab on the guide member is arranged to project therefrom slightly forward of the rear frame member, and (d) a body member is secured to each front and rear frame member.

* * * * *